US011246437B2

(12) United States Patent
Taylor

(10) Patent No.: US 11,246,437 B2
(45) Date of Patent: Feb. 15, 2022

(54) WEIGHTED CUP HOLDER

(71) Applicant: Robin Taylor, Charlton, MA (US)

(72) Inventor: Robin Taylor, Charlton, MA (US)

( * ) Notice: Subject to any disclaimer, the term of this patent is extended or adjusted under 35 U.S.C. 154(b) by 0 days.

(21) Appl. No.: 17/111,802

(22) Filed: Dec. 4, 2020

(65) Prior Publication Data

US 2021/0169254 A1 Jun. 10, 2021

Related U.S. Application Data

(60) Provisional application No. 62/944,550, filed on Dec. 6, 2019.

(51) Int. Cl.
*A47G 23/00* (2006.01)
*A47G 23/02* (2006.01)

(52) U.S. Cl.
CPC .... *A47G 23/0216* (2013.01); *A47G 2400/083* (2013.01)

(58) Field of Classification Search
None
See application file for complete search history.

(56) References Cited

U.S. PATENT DOCUMENTS 3,028,702 A * 4/1962 St Cyr ..... F16M 13/022 215/395
3,312,436 A * 4/1967 Beghetto, Jr. ..... A47G 23/0225 248/148
4,889,302 A * 12/1989 Tucker ..... A47G 23/0216 248/146
4,964,600 A * 10/1990 Lee ..... A47G 23/0225 248/146
5,743,500 A * 4/1998 Northway ..... A45C 11/008 206/457
8,087,528 B1 * 1/2012 Scarlett ..... A47G 23/0216 220/23.89
10,067,409 B2 * 9/2018 Elias ..... F16M 13/02

* cited by examiner

*Primary Examiner* — Steven M Marsh
(74) *Attorney, Agent, or Firm* — Brian M. Dingman; Dingman IP Law, PC

(57) ABSTRACT

A weighted cup holder with a weighted bag-like flexible base member that has a generally toroidal shape and a separate cup holder member. The base member and the cup holder member are configured to be removably coupled together into an assembly. When the assembly is placed on a surface, the cup holder member sits on the surface and the base member sits on part of the cup holder member and so acts to stabilize the cup holder member. A drink holder such as a bottle, glass or cup can be placed into and held in the cup holder member.

14 Claims, 5 Drawing Sheets

WEIGHTED CUP HOLDER

CROSS-REFERENCE TO RELATED APPLICATION

This application claims the priority of Provisional Application 62/944,550 filed on Dec. 6, 2019, the disclosure of which is incorporated herein by reference.

BACKGROUND

This application relates to a weighted cup holder.

Drinks are consumed while people are sitting on couches and chairs. There is often no easily accessible stable surface on which to place the drink.

SUMMARY

Featured in this disclosure is a weighted cup holder. The weighted cup holder comprises a weighted bag-like flexible base member that has a generally toroidal shape, and a separate cup holder member. The cup holder member has a closed bottom and an open top. The base member and cup holder member can be configured to be removably coupled together into an assembly. When the assembly is placed on a surface, the cup holder member sits on the surface and the base member sits on part of the cup holder member and so acts to stabilize the cup holder member. A drink holder such as a bottle, glass or cup can be placed into and held in the cup holder member. Since the drink holder is supported by a stabilized cup holder member, the drink is less likely to spill if it is jostled.

Preferably but not necessarily, the base member is filled with small non-toxic plastic beads or other loose particulates, and is sufficiently flexible that it can conform to different surfaces on which it may be placed. Preferably but not necessarily, the base member is shorter than the cup holder member. Preferably but not necessarily, the base member fits snugly around the cup holder member. Preferably but not necessarily, the base member has a plurality of loops on its interior surface that are constructed and arranged to releasably couple to the cup holder member. Preferably but not necessarily, the base member is made of a fabric material and is hand washable. In an example the base member includes a handle by which it (and any cup holder member) can be carried.

Preferably but not necessarily, the cup holder member is made of plastic. Preferably but not necessarily, the cup holder member has a plurality of tabs or hooks on the exterior of its wall and that are arranged to allow for releasable coupling of the base member to the cup holder member. Preferably but not necessarily, the cup holder member has a plurality of small projections or nubs near the tabs or hooks, to help inhibit the base member from mistakenly releasing from the cup holder member. Preferably but not necessarily, the cup holder member includes separate rings that snap on top of the upper rim of the cup holder member, to allow the opening size to be varied to accommodate different diameter drink holders. Preferably but not necessarily, the cup holder member is washable.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Examples of the devices, methods and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the devices, systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Figure 1B:
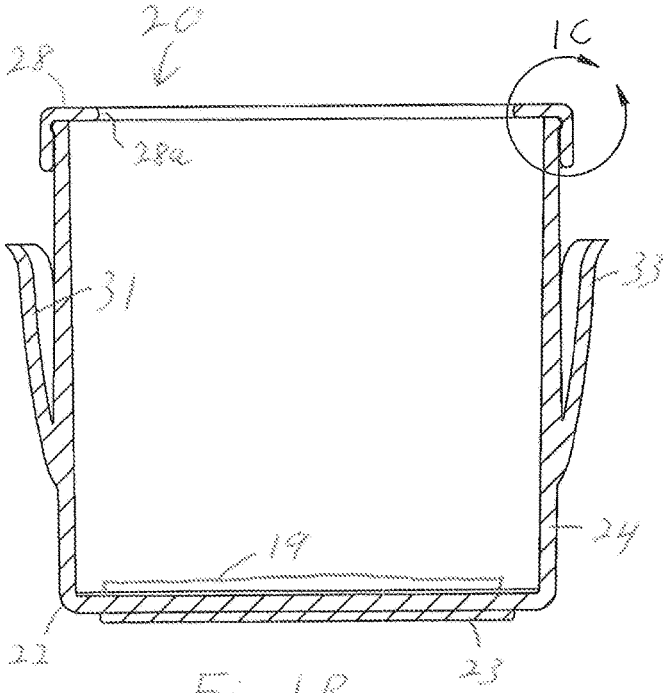
FIG. 1B is a cross-sectional view taken along line 1B-1B, FIG. 1A.
Figure 1A:
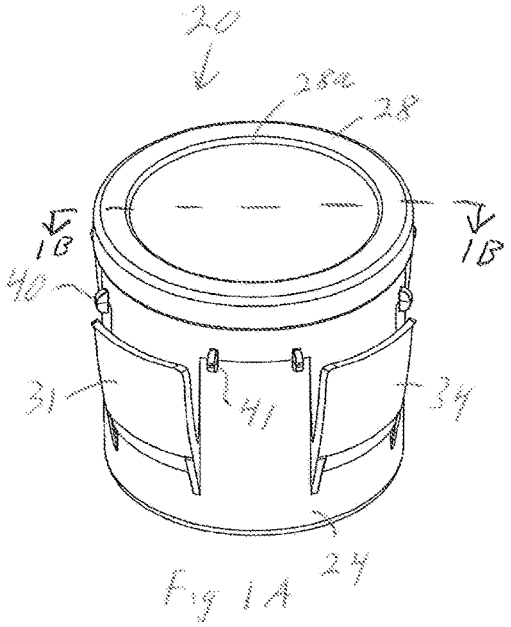
FIG. 1A is a perspective view of a cup holder member for a weighted cup holder.
Figure 1C:
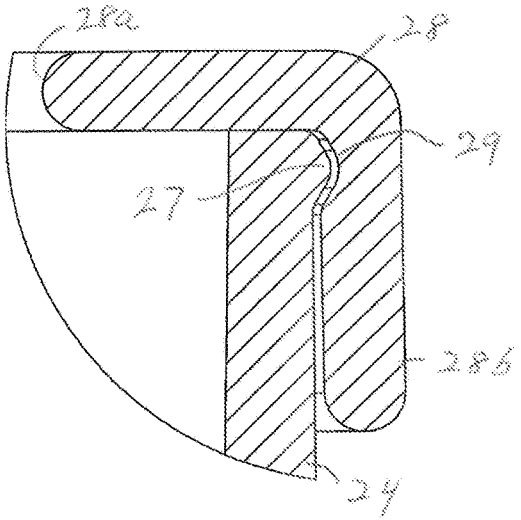
FIG. 1C is a detailed view of portion 1C of FIG. 1B.

Non-limiting examples of the weighted cup holder are shown in the enclosed drawings. Recited dimensions illustrate aspects of certain examples but are not limiting. FIGS. 1A-1C illustrate cup holder member 20 that in some examples has either a 3 inch or 3.5 inch opening. The weighted bag-like flexible base member, detailed in other drawings and described in more detail below, is configured to be removably coupled to the cup holder member.

The cup holder member 20 has a closed bottom 22 and an open top 26. Cup holder member 20 may or may not be insulated. The outside of the bottom may include an adhesive-backed rubber pad 23 that helps the assembly to grip surfaces and also protect furniture, while the inside can include a moisture-absorbent coaster 19 to help inhibit sweating. The cup holder member (e.g., the sidewall and/or the bottom) can be but need not be insulated. The base member and cup holder member can be configured to be removably coupled together into an assembly. When the assembly is placed on a surface, the cup holder member bottom sits on the surface and the base member acts to stabilize the cup holder member. A drink/liquid holder such as a bottle, glass, can or cup can be placed into and held in the cup holder member. Since the drink holder is supported by a stabilized cup holder member, the drink is less likely to spill if it is jostled. Separate ring 28 with inner edge 28*a* snaps on top of the upper rim of the cup holder member to narrow the opening size so as to accommodate different diameter drinks. There can be more than one such ring with different size openings (i.e., with inner edge 28*a* defining different inner diameters) to accommodate different diameter drinks. Also, ring skirt 28*b* defines an indentation 29 that fits over annular projection 27 to create a snap or interference fit between the lid and the cup holder member. Skirt 28*b* can have a desired length, which in one example is about one inch.

Figure 3:
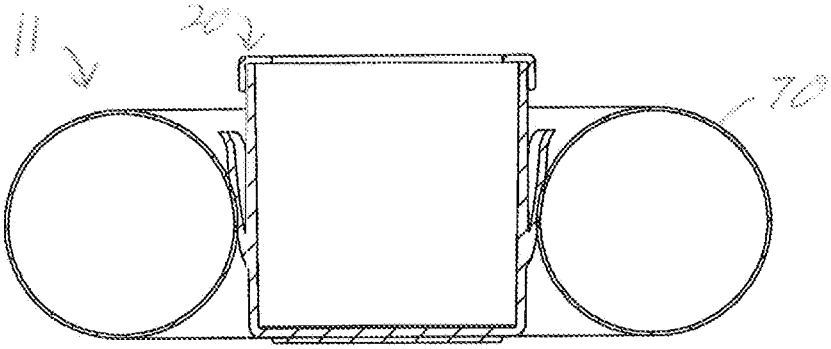
FIG. 3 is a cross-sectional view of an assembled weighted cup holder such as shown in FIG. 2B.
Figure 2B:
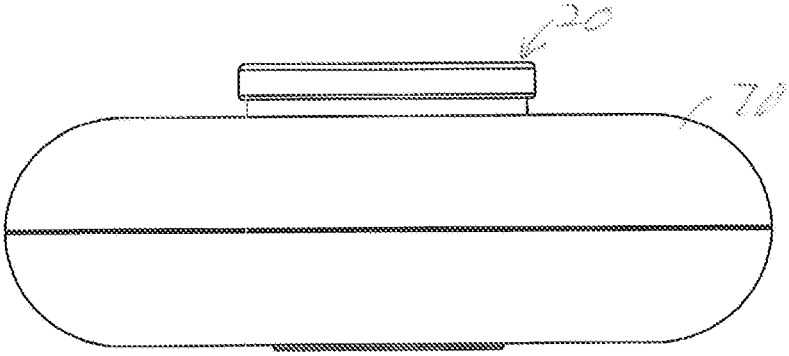
FIG. 2B is a side view of the flexible base member of FIG. 2A in place over a cup holder member.

The base member is flexible and has a generally toroidal shape. The interior is sized to snugly fit one of the cup holder members, as shown in the cross section of FIG. 3 (which illustrates weighted cup holder 11 with base member 70 located around cup holder member 20, but omits the base member's interior beads for the sake of clarity of illustration). The base member is weighted, preferably by being filled with small non-toxic plastic beads. The base member can be made of a tough fabric so it is flexible. The beads can be held in a separate plastic film envelope, making them less likely to spill if the fabric is torn. The result is a base member that is sufficiently flexible that it can conform to different surfaces on which it may be placed. The size (outer diameter) of the base member is preferably chosen so that it is sufficiently flexible. If the base member is too small it will be relatively stiff and so less able to conform to uneven surfaces. Multiple sizes can be offered. In an example there are two sizes that are appropriate for the two sizes of cup holder members set forth, but are not limiting of the scope of the disclosure. Preferably but not necessarily, the base member is shorter than the cup holder member as shown in FIG. 3. This allows easier user access to the cup holder member during assembly and disassembly. Preferably but not necessarily, the base member fits snugly around the cup holder member.

Figure 2A:
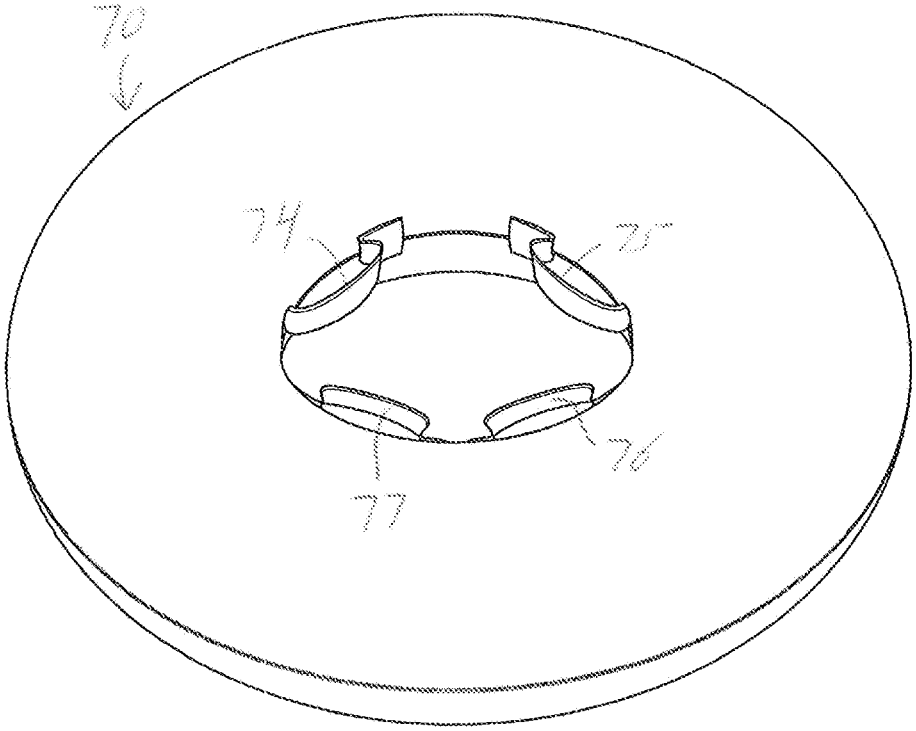
FIG. 2A is a perspective view of a flexible base member for a weighted cup holder.
Figure 5A:
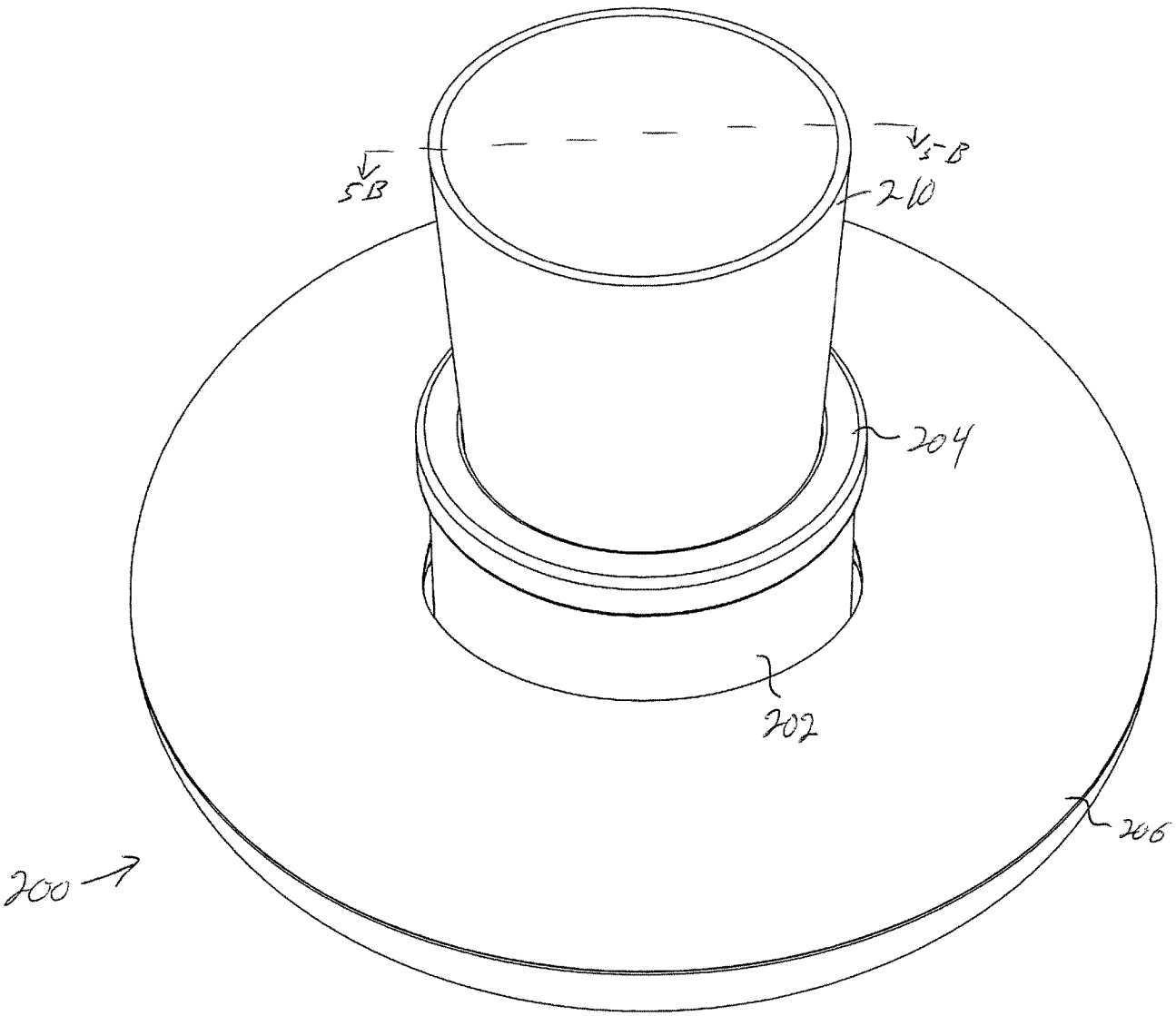
FIG. 5A is a perspective view of a weighted cup holder.
Figure 5B:
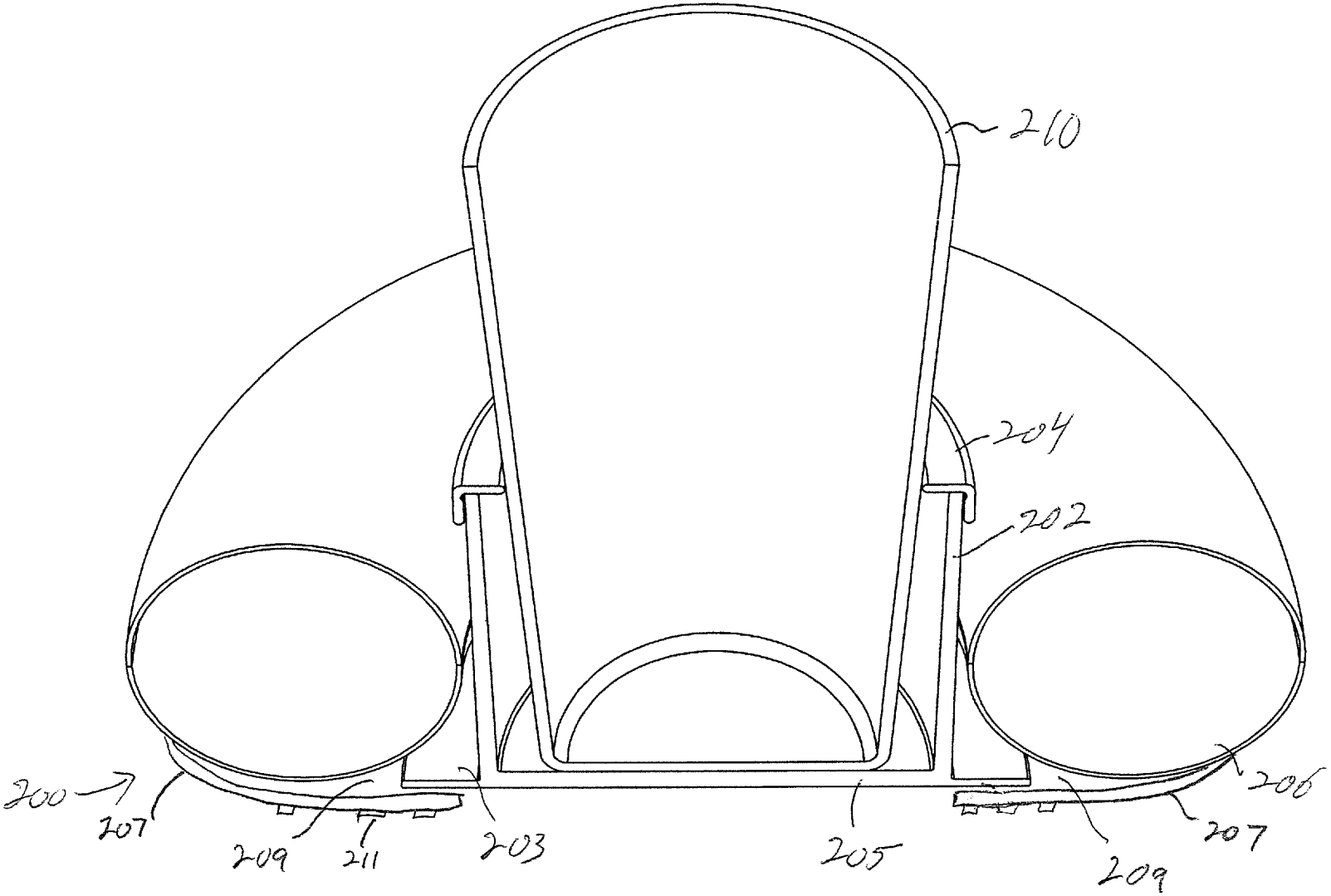
FIG. 5B is a cross-sectional view taken along line 5B-5B, FIG. 5A.

In some but not all examples the base member can have a plurality of loops (loops 74-77 shown on base member 70 in FIG. 2A) sewn spaced around its interior surface. Four loops are illustrated, but there could be fewer than or more than four, or there could be no loops. Four loops accomplish even anchoring of the base member and the cup holder member (when the cup holder member includes four tabs) and so are believed to be sufficient. The loops are constructed and arranged to couple to the cup holder member. This can be accomplished by including an optional equal plurality of hooks or tabs spaced around the external wall of the cup holder member and arranged such that the loops can slip over the open top of a hook/tab. See, for example, tabs 31, 33, 34, FIGS. 1A and 1B. The coupling is preferably but not necessarily relatively loose, so that the assembly is flexible and better able to conform to non-uniform surfaces. Note that in some examples the cup holder member does not include tabs and the base member does not include loops, for example as depicted in FIGS. 5A and 5B.

When present, the tabs are preferably but not necessarily coupled to the sidewall at their bottoms and diverge away from the sidewall so that there is a space or opening between the tab and the sidewall at the top of the tab. A fabric loop of a base member can be slipped over the tab via this opening, and snugged down onto the cup member. Coupling this way allows the assembly to be picked up by the cup holder member and remain together. An alternative would be to turn the tabs around, such that their openings were at the bottom rather than the top. Other manners of releasably coupling the base member and cup holder member are contemplated, and are included within the scope of the disclosure. See, for example, FIGS. 5A and 5B.

A series of optional small external bumps or projections can be included in the cup holder member sidewalls at about the level of the tops of the tabs. See FIG. 1A, which depicts two such projections per tab, at the height of the top of the tab and just outside of it. Projection pair 40 and 41 is numbered. These projections provide small barriers that help to inhibit the loops from slipping out of the tabs, to help keep the base member coupled to the cup holder member. On the other hand, since the loops and the base member are flexible, it is relatively easy for a person to pick up the assembly and slip the loops out of the tabs and so to disassemble the two for any reason, for example to wash the base member.

The cup holder member and the toroidal base member can be assembled by inserting the cup holder member into the bottom of the opening in the base member such that the fabric tabs slide into the opening between the tabs and the sidewall of the cup holder member.

Figure 4:
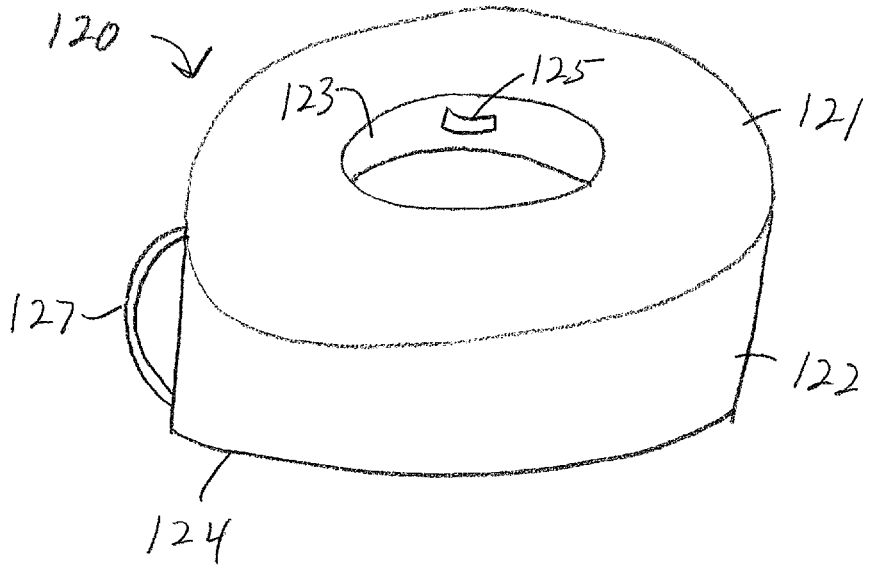
FIG. 4 is a perspective view of a flexible base member for a weighted cup holder.

In FIG. 4 base member 120 is detailed. This is one non-limiting construction of the base member. Base member 120 is constructed from four fabric pieces—the annular top 121 and annular bottom 124, and the annular inner wall 123 and annular outer wall 122. One loop 125 is shown. Having an inner wall helps to keep the base member upright. Without it the weight of the beads or other filler material can pull the top toward the bottom and cause the member to slump, making it less effective at holding the cup holder member in an upright position. The fabric can have a desired function and appearance. Preferably the fabric is washable and it can also be water-resistant. A waterproof canvas is another non-limiting example. Also, the base member can have a grippy bottom surface (as can the cup holder member) to help the assembly to be more stable. In some examples a fabric strip 127 is sewn to the side at its two ends, to act as a handle that can be used to pick up the member or the assembly.

In weighted cup holder 200, FIGS. 5A and 5B, base member 206 is configured to sit on top of the projecting base flange 203 of cup holder member 202. In some examples base member 206 includes an annular fabric flap 207 that is sewn to base member 206 and defines a pocket 209 into which flange 203 fits, as shown in FIG. 5B. This helps to couple the base member and the cup holder member together. The outside of flap 207 can include a number of small grippy feet 211 (e.g., small dots of a rubber or elastomer material) that help the assembly to grip a surface on which it is placed. Member 202 also includes closed bottom 205 that supports drink cup 210. Separate ring 204 snaps onto the top to size the opening.

A number of implementations have been described. Nevertheless, it will be understood that additional modifications may be made without departing from the scope of the inventive concepts described herein, and, accordingly, other examples are within the scope of the following claims.

Having described above several aspects of at least one example, it is to be appreciated various alterations, modifications, and improvements will readily occur to those skilled in the art. Such alterations, modifications, and improvements are intended to be part of this disclosure and are intended to be within the scope of the invention. Accordingly, the foregoing description and drawings are by way of example only, and the scope of the invention should be determined from proper construction of the appended claims, and their equivalents.

What is claimed is:

1. A weighted cup holder, comprising:

a weighted flexible base member that has a generally toroidal shape;

a separate cup holder member that has a sidewall with an exterior, an upper rim, and an opening size, wherein the cup holder member has a projecting base flange;

wherein the base member comprises an annular fabric flap that defines a pocket into which the base flange of the cup holder member fits; and wherein the base member and the cup holder member are configured to be removably coupled together into an assembly, wherein when the assembly is placed on a surface, the cup holder member sits on the surface and the base member sits on part of the cup holder member and so acts to stabilize the cup holder member, wherein a drink holder comprising a bottle, glass or cup can be placed into and held in the cup holder member.

2. The weighted cup holder of claim 1, wherein the base member is filled with small non-toxic plastic beads and is sufficiently flexible that it can conform to different surfaces on which it may be placed.

3. The weighted cup holder of claim 1, wherein the base member is shorter than the cup holder member.

4. The weighted cup holder of claim 1, wherein the base member fits snugly around the cup holder member.

5. The weighted cup holder of claim 1, wherein the base member has a plurality of loops on its interior surface that are constructed and arranged to couple to the cup holder member.

6. The weighted cup holder of claim 1, wherein the base member is made of a fabric material.

7. The weighted cup holder of claim 1, wherein the cup holder member is made of plastic.

8. The weighted cup holder of claim 1, wherein the cup holder member has a plurality of tabs or hooks on the exterior of its sidewall and that are arranged to allow for releasable coupling of the base member to the cup holder member.

9. The weighted cup holder of claim 8, wherein the cup holder member has a plurality of small projections or nubs near the tabs or hooks, to help inhibit the base member from mistakenly releasing from the cup holder member.

10. The weighted cup holder of claim 1, further comprising one or more separate rings that are configured to snap on top of the upper rim of the cup holder member, to allow the opening size of the cup holder member to be varied to accommodate different diameter drink holders.

11. The weighted cup holder of claim 1, wherein the cup holder member is made from plastic and is washable.

12. The weighted cup holder of claim 1, wherein the base member comprises a handle.

13. A weighted cup holder, comprising:

a weighted flexible base member made of a fabric material and that has a generally toroidal shape, is filled with small loose media, and is sufficiently flexible that it can conform to different surfaces on which it may be placed;

a separate plastic cup holder member that has a sidewall with an exterior, an upper rim, and an opening size;

one or more separate rings that are configured to snap on top of the upper rim of the cup holder member, to allow the opening size of the cup holder member to be varied to accommodate different diameter drink holders;

wherein the base member and the cup holder member are configured to be removably coupled together into an assembly, wherein when the assembly is placed on a surface the cup holder member sits on the surface and the base member sits on part of the cup holder member and so acts to stabilize the cup holder member, wherein a drink holder comprising a bottle, glass or cup can be placed into and held in the cup holder member;

wherein the base member is shorter than the cup holder member; wherein the base member fits snugly around the cup holder member; wherein the cup holder member has a projecting base flange and the flexible base member is configured to sit on the flange, wherein the base member comprises an annular fabric flap that defines a pocket into which the base flange fits.

14. A weighted cup holder, comprising:

a weighted flexible base member that has a generally toroidal shape;

a separate cup holder member that has a sidewall with an exterior, an upper rim, and an opening size; and one or more separate rings that are configured to snap on top of the upper rim of the cup holder member, to allow the opening size of the cup holder member to be varied to accommodate different diameter drink holders;

wherein the base member and the cup holder member are configured to be removably coupled together into an assembly, wherein when the assembly is placed on a surface, the cup holder member sits on the surface and the base member sits on part of the cup holder member and so acts to stabilize the cup holder member, wherein a drink holder comprising a bottle, glass or cup can be placed into and held in the cup holder member.

* * * * *